US007874421B2

(12) United States Patent
Bardet

(10) Patent No.: US 7,874,421 B2
(45) Date of Patent: Jan. 25, 2011

(54) CONTAINER HAVING MULTIPLE CONNECTED PACKS

(75) Inventor: Pierre-Alain Bardet, Grandson (CH)

(73) Assignee: Philip Morris USA Inc., Richmond, VA (US)

( * ) Notice: Subject to any disclaimer, the term of this patent is extended or adjusted under 35 U.S.C. 154(b) by 8 days.

(21) Appl. No.: 12/338,326

(22) Filed: Dec. 18, 2008

(65) Prior Publication Data

US 2009/0159472 A1 Jun. 25, 2009

(30) Foreign Application Priority Data

Dec. 24, 2007 (EP) ..... 07255038

(51) Int. Cl.
*A24F 15/00* (2006.01)
*B65D 85/10* (2006.01)
*B65D 85/12* (2006.01)

(52) U.S. Cl. ..... 206/256; 206/261; 206/273; 206/242; 229/120.09; 229/120.02; 229/120.03; 229/120.11

(58) Field of Classification Search ..... 206/256, 206/246, 261, 273, 242, 271, 265; 229/120.09, 229/120.02, 120.03, 120.08, 120.11
See application file for complete search history.

(56) References Cited

U.S. PATENT DOCUMENTS 1,906,742 A 5/1933 Coulapides
2,983,424 A * 5/1961 Glass ..... 229/121
3,007,623 A * 11/1961 Clemens ..... 229/120.03
4,149,666 A * 4/1979 Focke et al. ..... 206/271
5,344,008 A * 9/1994 DeBlasio et al. ..... 206/256
6,296,113 B1 * 10/2001 Bartels et al. ..... 206/261
D590,249 S * 4/2009 Yanchev ..... D9/421
2005/0252809 A1 * 11/2005 Aldridge et al. ..... 206/449

FOREIGN PATENT DOCUMENTS

FR 2614720 A 11/1988

OTHER PUBLICATIONS

European Search Report dated Jun. 26, 2008 for EP 07255038.7-2308.
International Search Report and Written Opinion mailed Mar. 31, 2009 for PCT/EP2008/010793.

* cited by examiner

*Primary Examiner*—Ehud Gartenberg
*Assistant Examiner*—Blaine G Neway
(74) *Attorney, Agent, or Firm*—Buchanan Ingersoll & Rooney PC

(57) ABSTRACT

A container comprises two or more connected packs at least one for housing a bundle of smoking articles. The container comprises a first pack having a first wall and a second, hinge-lid pack comprising a box part and a lid connected to the box part along a hinge line extending across a back wall of the second pack, wherein a wall of the lid is affixed to the first wall of the first pack.

18 Claims, 2 Drawing Sheets

CONTAINER HAVING MULTIPLE CONNECTED PACKS

CROSS-REFERENCE TO RELATED APPLICATION

This application claims priority under 35 U.S.C. §119 to European Application No. 07255038.7, filed Dec. 24, 2007, the entire content of which is hereby incorporated by reference.

FIELD OF THE INVENTION

The present invention relates to a container comprising two or more connected packs.

BACKGROUND

Smoking articles and other consumer goods are commonly packaged and sold in hinge-lid containers that comprise a box part and a lid, which is hinged to the back wall of the box part. It is known to package smoking articles in containers comprising two or more hinge-lid packs that are connected together in some way. For example, FR-A-2 614 720 discloses a so-called "booklet pack" for smoking articles comprising two or more cuboid packs connected together and pivotable relative to one another like the covers of a book.

It would be desirable to provide a container comprising two or more connected packs that provides novel ways for the consumer to access the smoking articles or other consumer goods within the container. It would also be desirable to provide a container comprising two or more connected packs that can be manufactured in a simple way.

SUMMARY

Disclosed herein is a container comprising two or more connected packs, the container comprising a first pack having a first wall; a second, hinge-lid pack comprising a box part and a lid connected to the box part along a hinge line extending across a back wall of the second pack, wherein a wall of the lid is affixed to the first wall of the first pack.

DETAILED DESCRIPTION

Figure 1:
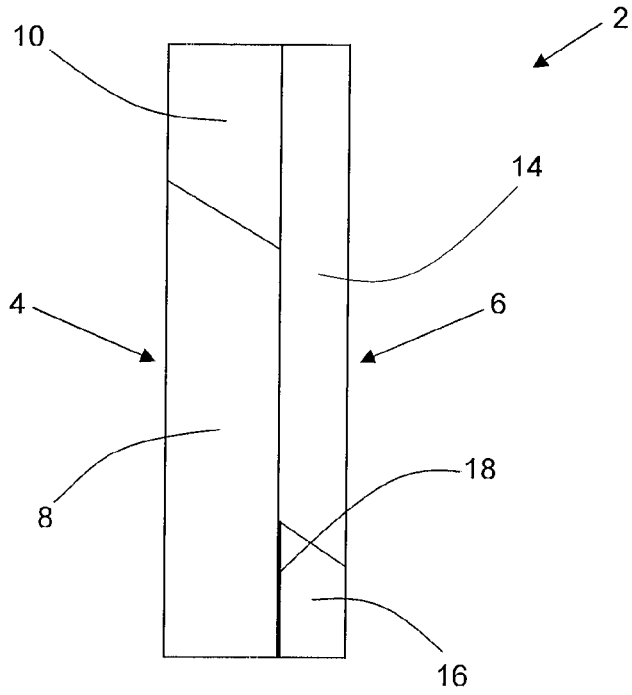
FIG. 1 shows a side view of a container according to a preferred embodiment, with the first pack and the second pack both in a closed position.

The terms "front", "back", "top" and "bottom" are used herein to describe the relative positions of the components of a hinge-lid pack when the pack is in an upright position. A hinge-lid pack is typically held in an upright position by the consumer during opening of the pack so that the articles in the pack may be removed through the top side of the open pack. When describing containers according to various embodiments, these terms are used irrespective of the orientation of the hinge-lid pack being described.

Throughout the specification, the terms are used as follows for a hinge-lid pack. The top wall is the wall of the lid that covers the opening of the box part of the container. The bottom wall is the wall opposite the top wall. The top wall and the bottom wall are connected by a number of upright walls. Typically, the lid and the box part have the following upright walls: a front wall; a back wall; and at least two side walls. However, in a pack with a triangular cross-section the front wall is missing. The hinge is located on the back wall. Where present, the front wall is the wall opposite the back wall. The side walls are the remaining upright walls. Typically, in hinge-lid packs the back wall and the front wall are major walls, that is, they have the biggest surface area of the pack. In so-called side-opening packs the hinge is located on a minor wall, such that the side walls are the major walls of the pack. In packs with a quadratic cross-section the front wall, back wall and side walls are all major walls.

Preferably, the first wall of the first pack is the front wall or a side wall. Preferably, the wall of the lid of the second pack affixed to the first wall of the first pack is the front wall of the lid or a side wall of the lid.

The first and second packs of containers disclosed herein are connected directly to each other without intermediate connecting panels. Such containers can therefore be produced in a simple way using the same blanks as known packs and using apparatus used to manufacture known packs.

Advantageously, containers disclosed herein provide a greater external surface area upon which manufacturer or brand logos, trade marks, slogans and other consumer information can be displayed. In preferred embodiments, a portion of the exterior surface of the first and second packs will only be exposed when the second pack is opened. This portion may therefore be used to display additional information or graphics.

The first pack may be a slide and shell pack comprising an outer shell and an inner slide within the outer shell, or a side opening pack. Also, the second pack may be a sliding lid pack as disclosed in Registered EU Community Design No. 000557590.

Alternatively, and preferably, the first pack is a hinge-lid pack comprising a box part and a lid hinged to the box part. The first hinge-lid pack and the second hinge-lid pack may be connected together such that first hinge-lid pack may be opened independently from the second hinge-lid pack. Alternatively, the first hinge-lid pack and the second hinge-lid pack may be connected together such that the second hinge-lid pack is at least partially open before the first hinge-lid pack can be opened.

Preferably, where the first pack is a hinge-lid pack, the front wall of the lid of the second pack is affixed to the front wall of the box part of the first pack. Particularly preferably, the front wall of the lid of the second hinge-lid pack is affixed to the lower end of the front wall of the box part of the first hinge-lid pack, so that when the second pack is in a closed position the front wall of the first pack lies against the front wall of the second pack. Alternatively, the front wall of the lid of the second pack may be attached to the lower end of the back wall of the first pack.

In an open position, the opening in the box part of the second hinge-lid pack is at the top of the pack. Similarly, in an open position, the opening in the box part of the first hinge-lid pack is at the top of the pack. This allows the consumer to open both the first hinge-lid pack and the second hinge-lid pack at the same time, without the risk of losing articles housed in either pack.

Containers described herein preferably further comprise retention means to provide resistance to movement of the second pack relative to the first pack from a closed position to an open position, such that a positive force must be applied to move the second pack relative to the first pack. The retention means may comprise any suitable known magnetic fasteners, mechanical fasteners, adhesive fasteners or combinations thereof. For example, the retention means may comprise one or more releasable pressure-actuated hook and loop type fasteners, snap fasteners or other mating plug and socket type fasteners.

In one preferred embodiment, the first pack is a hinge-lid pack comprising a lid that closes over both the second hinge-lid pack and the box part of the first hinge-lid pack. The lid of the first hinge-lid pack therefore acts as a retention means, holding the first and second hinge-lid packs together with the second pack in a closed position. The lid of the first hinge-lid pack must be opened before the lid of the second hinge-lid pack can be opened. Conversely, the first hinge-lid pack may be opened simply by opening the lid thereof.

At least one of the packs of the containers is for housing a bundle of smoking articles. The smoking articles may be, for example, cigarettes, such as lit end cigarettes or cigarettes for use with electrical smoking systems, cigars or cigarillos. Preferably, the first pack and the second pack are each for housing a separate bundle of cigarettes. Alternatively, one of the first pack or the second pack is for housing one or more items other than a smoking article, for example, cigarette butts, filter components, matches, lighters, cosmetics or an information leaflet or booklet.

Through an appropriate choice of the dimensions thereof, the first pack and the second pack of containers described herein may be designed to house separate bundles of different numbers of cigarettes. Alternatively, or in addition, the first pack and the second pack may be designed to house separate bundles of cigarettes of different dimensions (for example, cigarettes of different length or different circumference). The first pack and the second pack may, for example, be designed to house separate bundles of different numbers of short (for example between about 30 mm and about 75 mm in length), regular size (for example about 80 mm in length), king size (for example about 84 mm in length), super king size, slender or wide cigarettes.

Through an appropriate choice of the dimensions of the first pack and the second pack thereof, containers described herein may also be designed to hold different total numbers of smoking articles. For example, such containers may comprise a first pack and a second pack for housing, in combination, a total of twenty regular size cigarettes. The number of smoking articles housed in the first pack may be the same as, or different to, the number of smoking articles housed in the second pack.

Through an appropriate choice of the dimensions thereof, the containers or each of the first and second packs thereof may be designed to hold a total of, for example, ten, fifteen, sixteen, seventeen, eighteen, nineteen, twenty, twenty-one or twenty-five smoking articles. These may be arranged in different collations, depending on the total number of smoking articles. For example, the smoking articles may be arranged in one row of six, seven, eight, nine or ten; two rows of five, six, seven, eight, nine or ten; two rows of 5-6, 6-7, 7-8; three rows of 5-5-5, 5-6-5, 6-5-6, 5-6-7, 6-7-6, 7-5-7, 7-6-7, 7-7-7, 8-9-8; four rows of four, five or six.

The length, width and depth of the first pack and the second pack of containers may be such that, when the second pack is in a closed position, the resultant overall dimensions of the containers are, for example, substantially the same as those of known hinge-lid containers holding twenty smoking articles.

Containers described herein may advantageously comprise a first pack and a second pack for housing separate bundles of smoking articles of different types. A wide variety of different types of cigarettes are produced and sold. For example, different types of tobacco having unique characteristic tastes and aromas, such as Burley, Oriental and Virginia tobacco, are used alone or in varying amounts in tobacco blends to produce brands of cigarettes having different characteristic tastes. In addition, both filterless cigarettes and cigarettes having many different types of filter tips are manufactured as well as cigarettes of differing length (for example, regular size, king size or super-king size), circumference (for example, slender), strength of taste, resistance to draw and total particulate matter delivery. Furthermore, cigarettes containing flavourings such as menthol are also available.

Containers described herein may comprise a first pack and a second pack for housing separate bundles of cigarettes of a different tobacco blend or flavour. Alternatively, or in addition, such containers may comprise a first pack and a second pack for housing separate bundles of cigarettes of a different size (different length, different circumference, or both).

Preferably, the first pack and the second pack are substantially parallelepidal. More preferably, the first pack and the second pack are substantially cuboid.

Preferably, the first pack and the second pack are of substantially the same shape. The dimensions of the first pack and the second pack may be the same of different. Preferably, the first pack and the second pack are of different dimensions. More preferably, the first pack and the second pack are of substantially the same length (or height) and width, but of different depth, that is, the same size major walls, but different size minor walls. Preferably, the faces of the first pack and the second pack that abut one another when the packs are closed are of substantially the same dimensions.

The first pack and the second pack may have one or more right-angled longitudinal edges, one or more right-angled transverse edges, one or more rounded longitudinal edges, one or more rounded transverse edges, one or more bevelled longitudinal edges, one or more bevelled transverse edges, or any suitable combination thereof. Preferably, the longitudinal edges of the abutting walls of the two packs are right-angled, such that the container has a smooth side where the edges of the two packs abut.

The first pack and the second pack are preferably formed from one or more folded laminar blanks, more preferably from one or more folded laminar cardboard blanks.

The second pack is preferably adhered to the first wall of the first pack in order to form the container, for example, using hot melt adhesive, contact adhesive or double-sided adhesive tape. However, it will be appreciated that a variety of other known connecting means may be employed to affix the lid of the second pack to the first wall of the first pack such as, for example, hook and loop type fasteners, magnetic fasteners or mating plug and socket type fasteners.

The exterior surfaces of the first pack and the second pack may be printed, embossed, debossed, or otherwise embellished (for example using labels or stickers) with manufacturer or brand logos, trade marks, slogans and other consumer information and indicia. It will be appreciated that the same or different manufacturer or brand logos, trade marks slogans and other consumer information and indicia may be applied to the exterior surfaces of the first pack and the second pack.

At least one of the walls of the first pack, or the second pack, or both, may be at least partially provided with a higher friction exterior surface in order to improve the consumer's grip on the packs during opening and closing thereof. Preferably, the two side walls of the first pack are at least partially provided with such a high friction surface. Alternatively, or in addition, the first pack, or the second pack, or both, may include a mirrored surface on at least one surface thereof that only becomes exposed when the second pack is open.

The exterior surfaces of the first pack and the second pack may be printed such that when the packs are both closed, the container has the appearance of a single pack. Alternatively, the exterior surfaces of the first pack and the second pack may be printed so that they contrast with each other and it is easy for the consumer to distinguish the packs from each other. This may be desired, for example, if different brands of smoking articles are housed in the first pack and the second pack, since each of the packs may be printed with marketing and consumer information relating to the brand of smoking articles housed within that pack.

The interior surfaces of the lid of the first pack, or the second pack, or both, may also be printed. For example, the interior surfaces of the lid of the second pack may be printed with a continuation of the image that is printed on the first wall of the first pack, so that the image is continued or completed when the second pack is in its open position and the interior surfaces of the lid of the second pack are exposed.

The container may be printed with indicia to indicate the direction in which to open the packs, for example, with one or more arrows, or explanatory text.

Containers described herein may comprise more than two packs, for example, three, four, five or six packs. Third and subsequent packs may be connected to one or more other packs in the same or a different manner to that in which the first pack and the second pack are connected. For example, a third hinge-lid pack may be incorporated into the container described above, in which the front wall of the lid of the second hinge-lid pack is affixed to the front wall of the box part of the first pack, by attaching the front wall of the lid of the third pack to the front wall of the box part of the second pack. In the closed position, the third pack lies between the first pack and the second pack with the lid of the second pack closed over both the third pack and the box part of the second pack. In order to open the second pack, the box part of the second pack and the third pack are together rotated about the hinge line in the back wall of the second pack, away from the first pack, (in the same way as described above to open the second pack of a container having only two packs). The third pack can then be opened by rotating it about the hinge line in the back wall thereof, away from the second pack. The third pack may house the same or different smoking articles or other items to the first pack and the second pack.

Containers described herein may be shrink wrapped, or otherwise over wrapped with a transparent polymeric film of, for example, polyethylene or polypropylene, in a known manner. Where such containers are over wrapped, the over wrapper may include a tear tape. Preferably, the tear tape extends in a vertical direction around the pack, so that the entire over wrap is removed when the consumer pulls on the tear tape.

A method for producing containers as described above comprises: forming the first pack from one or more laminar blanks; forming the second pack from one or more laminar blanks; applying adhesive to a wall of the lid of the second pack; and affixing the wall of the lid of the second pack to which the adhesive has been applied to the first wall of the first pack.

Preferably, the application of the adhesive and the affixing of the second pack to the first pack are carried out in line. Advantageously, therefore, only simple modifications to existing methods and apparatus for making known packs are required in order to incorporate the additional steps required for producing containers according to the present invention.

Figure 2:
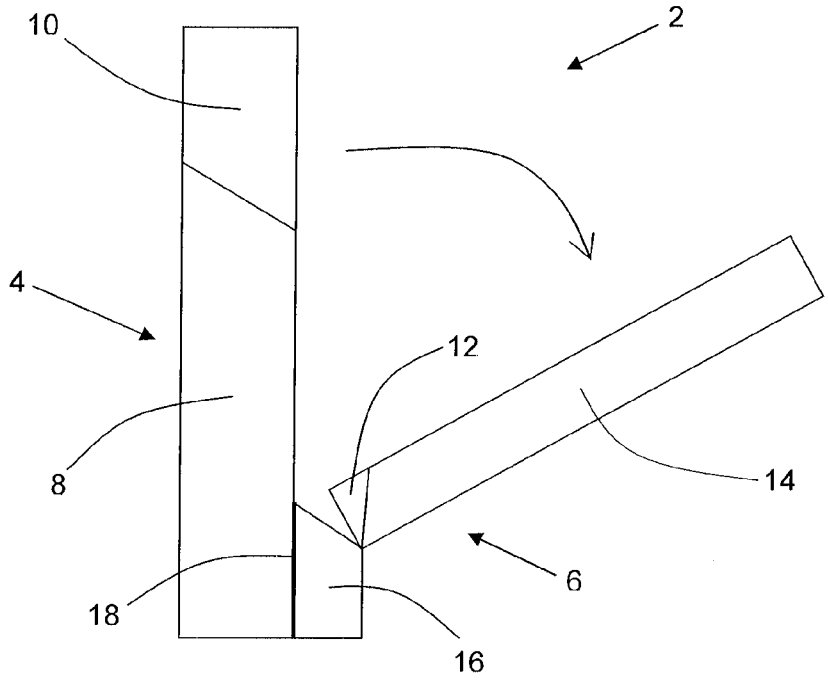
FIG. 2 illustrates a method for opening the second pack of the container shown in FIG. 1.
Figure 3:
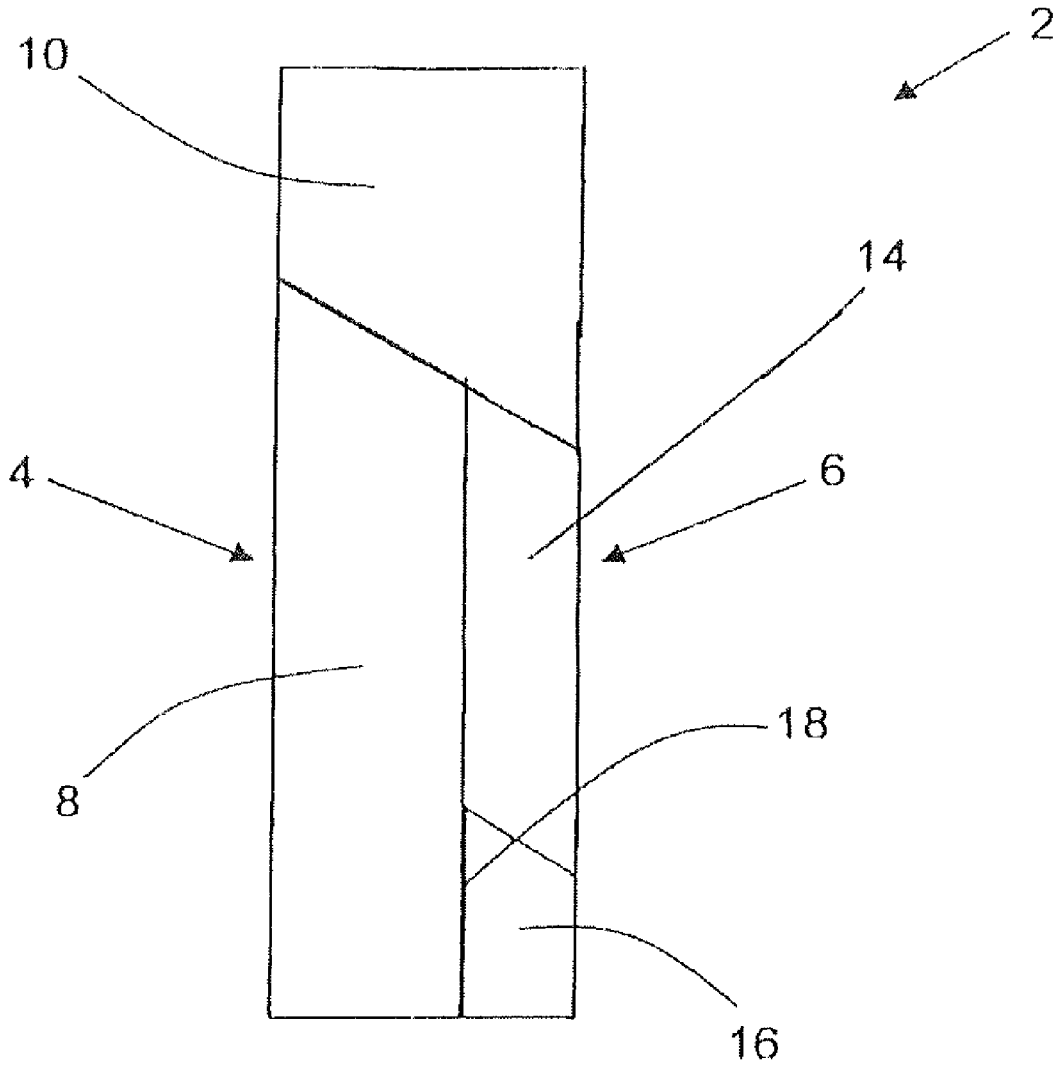
FIG. 3 shows a side view of a container according to another preferred embodiment, with the first pack and the second pack both in a closed position.

The container 2 shown in FIGS. 1 and 2 is substantially rectangular cuboidal in shape and comprises a first hinge-lid pack 4 connected to a second hinge-lid pack 6. The first hinge-lid pack 4 contains a wrapped bundle of two rows of filter cigarettes and has a construction similar to that of known hinge-lid cigarette packs, with a box part 8 and a lid 10 hinged to the back wall of the box part 8. The second hinge-lid pack 6 contains a wrapped bundle 12 of one row of filter cigarettes and also has a construction similar to that of known hinge-lid cigarette packs, with a box part 14 and a lid 16 hinged to the back wall of the box part 14. The first pack 4 and the second pack 6 are both rectangular cuboidal in shape and have the same height and width as each other; however, the depth of the second pack 6 is approximately half of the depth of the first pack 4, since it contains one less row of cigarettes.

The front wall of the lid 16 of the second pack 6 is affixed, by means of an adhesive 18, to the bottom end of the front wall of the box part 8 of the first pack 4, such that the top wall of the lid 16 of the second pack 6 and the bottom wall of the box part 8 of the first pack 4 are substantially co-planar and form the bottom wall of the container 2. As shown in FIG. 1, when the first pack 4 and the second pack 6 are both in a closed position, their front faces lie against one another with their front walls substantially coinciding, so that the front face of the first pack is entirely covered by the second pack and vice versa.

FIG. 2 illustrates one possible method of opening the second pack in order to access the cigarettes housed therein. The first pack 4 is held in an upright position while the box part 14 of the second pack 6 is rotated away from the first pack 4 about the hinge line in the back wall of the second pack 6, in the direction shown by the arrow in FIG. 2. The lid 16 of the second pack 6 remains attached to the first pack and therefore as the box part 14 of the second pack 6 is rotated away from the first pack 4 the opening in the box part 14 of the second pack 6 is exposed.

Once the second pack 6 has been at least partially opened, the first pack 4 can be opened by pivoting the lid 10 of the first pack 4 about the hinge line in the back wall of the first pack 4.

To form a container 2 as described above, the first hinge-lid pack 4 and the second hinge-lid pack 6 are each formed from a laminar cardboard blank, in a known manner, and filled with a wrapped bundle of cigarettes. Adhesive 18 is applied to the front wall of the lid 16 of the second pack 6 and the front wall of the lid 16 of the second pack 6 with the adhesive 18 applied thereto is affixed to the bottom end of the front wall of the first pack 4, so that the first 4 and second 6 packs are lined up with each other to provide a rectangular cuboidal container 2. The container 2 comprising the connected first 4 and second 6 packs is then over wrapped in a known manner with a transparent film (not shown).

While various embodiments have been described, it is to be understood that variations and modifications may be resorted to as will be apparent to those skilled in the art. Such variations and modifications are to be considered within the purview and scope of the claims appended hereto.

The invention claimed is:

1. A container comprising two or more connected packs, the container comprising:

a first, hinge-lid pack comprising a box part and a lid connected to the box part along a hinge line extending across a back wall of the first pack, the box part and the lid of the first pack each having a front wall, a back wall and two side walls;

a second, hinge-lid pack comprising a box part and a lid connected to the box part along a hinge line extending across a back wall of the second pack, the box part and the lid of the second pack each having a front wall, a back wall and two side walls; and wherein the front wall of the lid of the second pack is adhesively affixed to the front wall of the box part of the first pack and wherein in a closed position, the front wall of the first pack is entirely covered by the front wall of the second pack and the front wall of second pack is entirely covered by the front wall of the first pack.

2. A container according to claim 1, wherein the front wall of the lid of the second pack is adhesively affixed to a bottom of the front wall of the first pack such that when the second pack is in a closed position, the front wall of the second pack lies against the front wall of the first pack.

3. A container according to claim 1, wherein the lid of the first pack closes over the second pack when the second pack is in a closed position.

4. A container according to claim 1, wherein the first pack and the second pack are of different dimensions.

5. A method of producing a container according to claim 1, comprising:

forming the first pack from one or more laminar blanks;

forming the second pack from one or more laminar blanks;

applying adhesive to the front wall of the lid of the second pack; and affixing the front wall of the lid of the second pack to which the adhesive has been applied to the front wall of the first pack.

6. A container according to claim 1, wherein the first pack and the second pack are connected directly to each other without intermediate connecting panels.

7. A container according to claim 1, wherein the front wall of the first pack and the front wall of the second pack are exposed only upon opening of the container.

8. A container according to claim 1, wherein the second pack must be at least partially opened before the first pack can be opened.

9. A container according to claim 7, wherein the lid of the first pack must be opened before the lid of the second pack can be opened.

10. A container according to claim 1, wherein the first pack and the second pack are substantially parallelepidal.

11. A container according to claim 1, wherein the first pack and the second pack are substantially cuboid.

12. A container according to claim 1, wherein the first pack and the second pack are formed from one or more folded laminar blanks.

13. A container according to claim 1, wherein the first pack and the second pack have one or more longitudinal edges, and wherein the one or more longitudinal edges of abutting walls of the first and second packs are right-angled, such that the container has a smooth side where the one or more longitudinal edges of the first and the second pack abut.

14. A container according to claim 1, wherein the box part of the first pack has a bottom wall, and the box part of the second pack has a top wall.

15. A container according to claim 14, wherein the lid of the first pack has a top wall, and the lid of the second pack has a bottom wall.

16. A container according to claim 1, further comprising a retention means, which provides resistance to movement of the second pack relative to the first pack from a closed position to an open position, such that a positive force must be applied to move the second pack relative to the first pack.

17. A container according to claim 1, wherein at least one of the first and second packs houses a bundle of smoking articles.

18. A container according to claim 1, wherein in an open position, the lid of the second pack remains attached to the box part of the first pack, and as the box part of the second pack is rotated away from the first pack, an opening in the box part of the second pack is exposed.

* * * * *